US005743025A

United States Patent [19]

Jordan, Jr.

[11] Patent Number: 5,743,025

[45] Date of Patent: Apr. 28, 1998

[54] DRYER BASKET FOR SNEAKERS INSERTABLE INTO A CLOTHES DRYER

[76] Inventor: Richard W. Jordan, Jr., 26 Sunset Rd., Norton, Mass. 02766

[21] Appl. No.: 831,901

[22] Filed: Apr. 3, 1997

[51] Int. Cl.[6] ..... F26B 11/02

[52] U.S. Cl. ..... 34/600

[58] Field of Search ..... 34/90, 104, 109, 34/202, 204, 237, 239, 240; D32/36

[56] References Cited

U.S. PATENT DOCUMENTS

| | | | |
|---|---|---|---|
| D. 335,008 | 4/1993 | Abel | D32/36 |
| 3,316,659 | 5/1967 | Lauck | 34/600 |
| 3,344,532 | 10/1967 | Bigler | 34/600 |
| 4,109,397 | 8/1978 | Daily | 34/239 |
| 4,617,743 | 10/1986 | Barnard | 34/109 |

*Primary Examiner*—Henry A. Bennett
*Assistant Examiner*—Steve Gravini

[57] ABSTRACT

A dryer basket for sneakers including a plurality of baskets. A plurality of mounting brackets are secured within a dryer drum of a dryer adjacent to tumblers of the dryer. The mounting brackets each are removably secured to the baskets whereby the baskets are removably secured within the dryer drum adjacent to the tumblers.

7 Claims, 3 Drawing Sheets

FIG.1
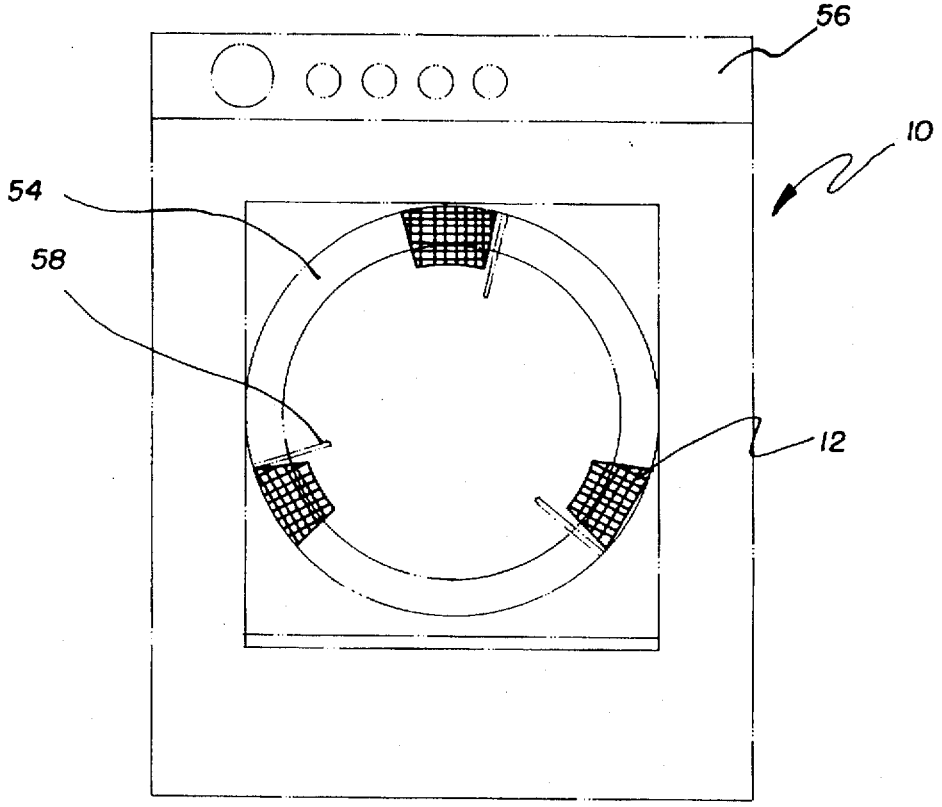
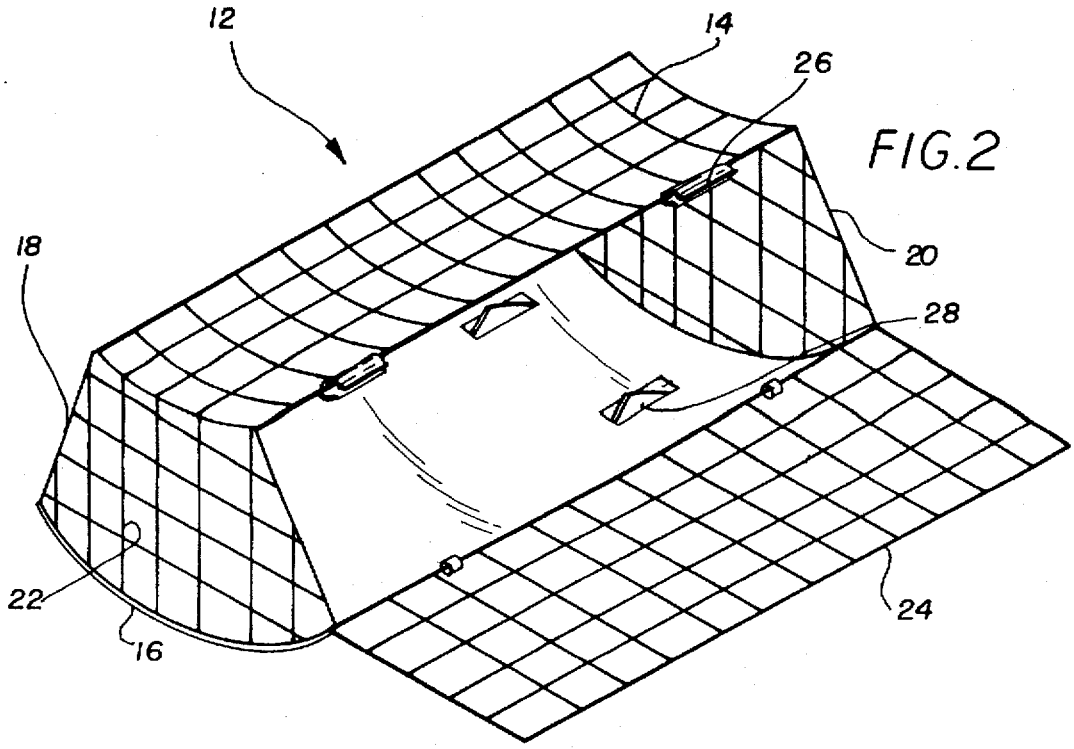
FIG.2

DRYER BASKET FOR SNEAKERS INSERTABLE INTO A CLOTHES DRYER

BACKGROUND OF THE INVENTION

1. Field of the Invention

The present invention relates to a dryer basket for sneakers and more particularly pertains to allowing laundered sneakers to be dried in an automatic dryer without any noise with a dryer basket for sneakers.

2. Description of the Prior Art

The use of dryer inserts is known in the prior art. More specifically, dryer inserts heretofore devised and utilized for the purpose of holding objects within a dryer drum are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,617,743 to Barnard discloses a dryer insert, holder, container. U.S. Pat. No. 4,109,397 to Daily discloses a rotatable, non-tumbling drying rack. U.S. Pat. No. Des. 335,008 to Abel discloses the ornamental design for a clothes and shoe holder for clothes dryer. U.S. Pat. No. 4,813,641 to Wilson discloses a device and method for attaching an object to a surface. U.S. Pat. No. 4,702,016 to Grigsby et al. discloses an apparatus for drying shoes in a dryer.

While these devices fulfill their respective, particular objective and requirements, the aforementioned patents do not describe a dryer basket for sneakers for allowing laundered sneakers to be dried in an automatic dryer without any noise.

In this respect, the dryer basket for sneakers according to the present invention substantially departs from the conventional concepts and designs of the prior art, and in doing so provides an apparatus primarily developed for the purpose of allowing laundered sneakers to be dried in an automatic dryer without any noise.

Therefore, it can be appreciated that there exists a continuing need for new and improved dryer basket for sneakers which can be used for allowing laundered sneakers to be dried in an automatic dryer without any noise. In this regard, the present invention substantially fulfills this need.

SUMMARY OF THE INVENTION

In the view of the foregoing disadvantages inherent in the known types of dryer inserts now present in the prior art, the present invention provides an improved dryer basket for sneakers. As such, the general purpose of the present invention, which will be described subsequently in greater detail, is to provide a new and improved dryer basket for sneakers and method which has all the advantages of the prior art and none of the disadvantages.

To attain this, the present invention essentially comprises three baskets. Each of the baskets has a curved upper wall, a curved lower wall, an interior wall, an open exterior wall, and opposed side walls. The open exterior wall has a door hingedly secured thereto. A pair of lid clips are secured to an upper edge of the open exterior wall for engaging the door in a closed orientation to form an enclosure. The curved lower wall has a pivot clip rotatably disposed within a slot formed through the curved lower wall. The pivot clip has an upper arm and a lower arm. The curved lower wall has a retaining pin extending downwardly therefrom. The retaining pin has an enlarged lower end. The device includes three mounting brackets. Each of the mounting brackets have a planar upper surface, a planar lower surface and opposed curved end portions. The planar lower surface has an adhesive layer disposed thereon. The three mounting brackets are secured within a dryer drum of a dryer adjacent to tumblers of the dryer. The planar upper surface of each mounting bracket has a clip receiving slot and a pin receiving slot formed therein. The clip receiving slot is dimensioned for receiving the lower arm of the pivot clip therein and the pin receiving slot is dimensioned for receiving the enlarged lower end of the retaining pin therein whereby the three baskets are secured within the dryer drum adjacent to the tumblers. The device includes at least one balancing weight. The balancing weight comprises a container holding a predetermined amount of sand therein. The container has an open threaded collar to facilitate adding to and removing sand from the container. A lid removably is coupled with the collar. The balancing weight is positionable within one of the baskets.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dryer basket for sneakers which has all the advantages of the prior art dryer inserts and none of the disadvantages.

It is another object of the present invention to provide a new and improved dryer basket for sneakers which may be easily and efficiently manufactured and marketed.

It is a further object of the present invention to provide a new and improved dryer basket for sneakers which is of durable and reliable construction.

An even further object of the present invention is to provide a new and improved basket for sneakers which is susceptible of a low cost of manufacture with regard to both materials and labor, and which accordingly is then susceptible of low prices of sale to the consuming public, thereby making such a dryer basket for sneakers economically available to the buying public.

Even still another object of the present invention is to provide a new and improved dryer basket for sneakers for allowing laundered sneakers to be dried in an automatic dryer without any noise.

Lastly, it is an object of the present invention to provide a new and improved dryer basket for sneakers including a plurality of baskets. A plurality of mounting brackets are secured within a dryer drum of a dryer adjacent to tumblers of the dryer. The mounting brackets each have means for securement to the baskets whereby the baskets are removably secured within the dryer drum adjacent to the tumblers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of the preferred embodiment of the dryer basket for sneakers constructed in accordance with the principles of the present invention.

FIG. 2 is a perspective view of one of the baskets of the present invention.

The same reference numerals refer to the same parts through the various figures.

DESCRIPTION OF THE PREFERRED EMBODIMENT

Figure 3:
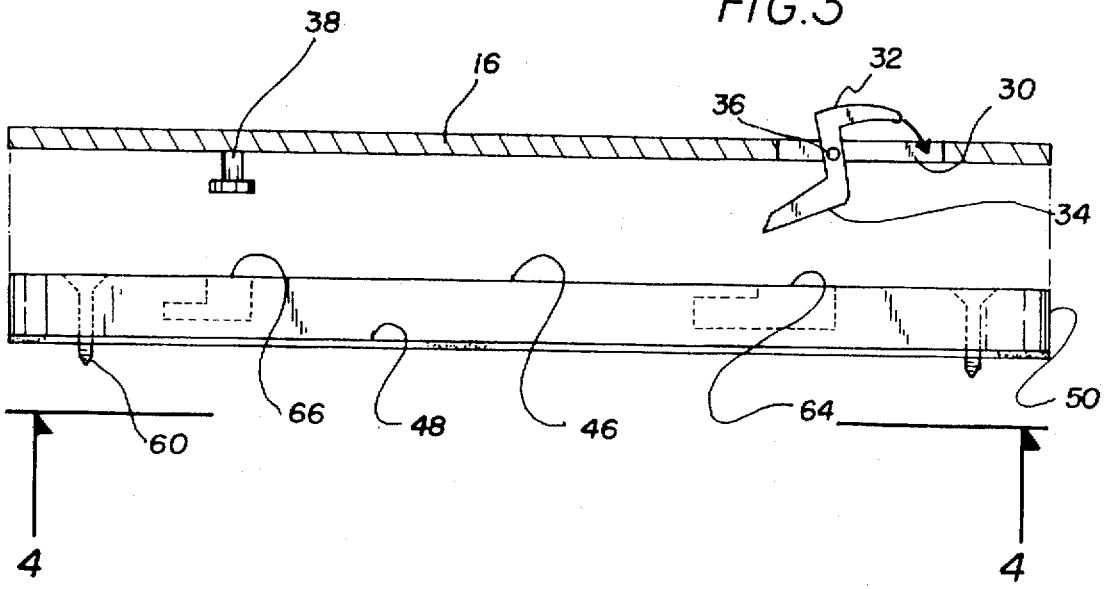
FIG. 3 is a side view of the mounting brackets as secured to the baskets.
Figure 4:
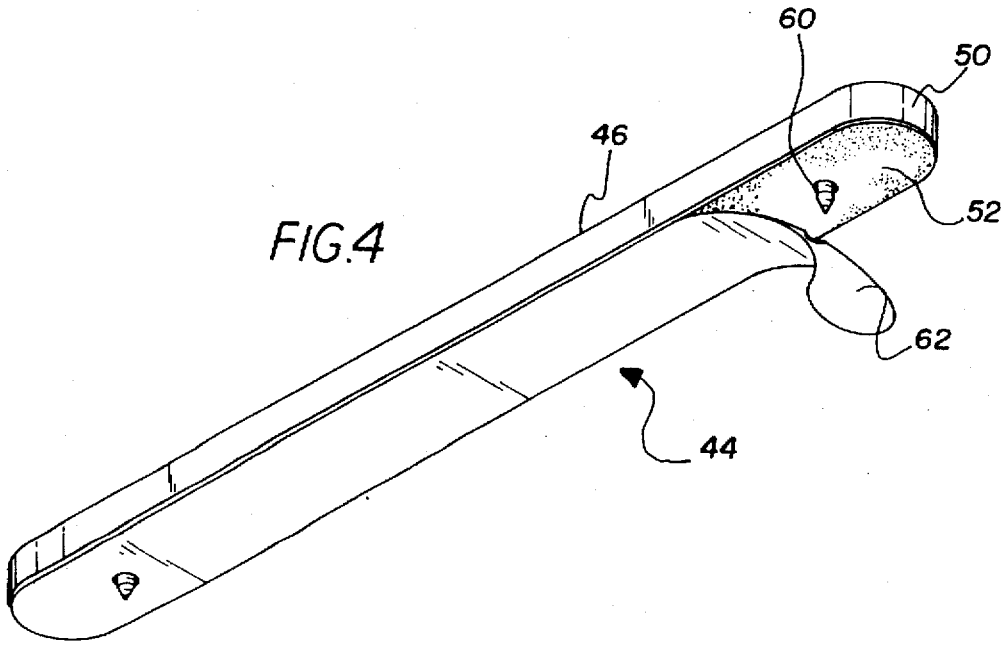
FIG. 4 is bottom perspective view of the mounting bracket.
Figure 5:
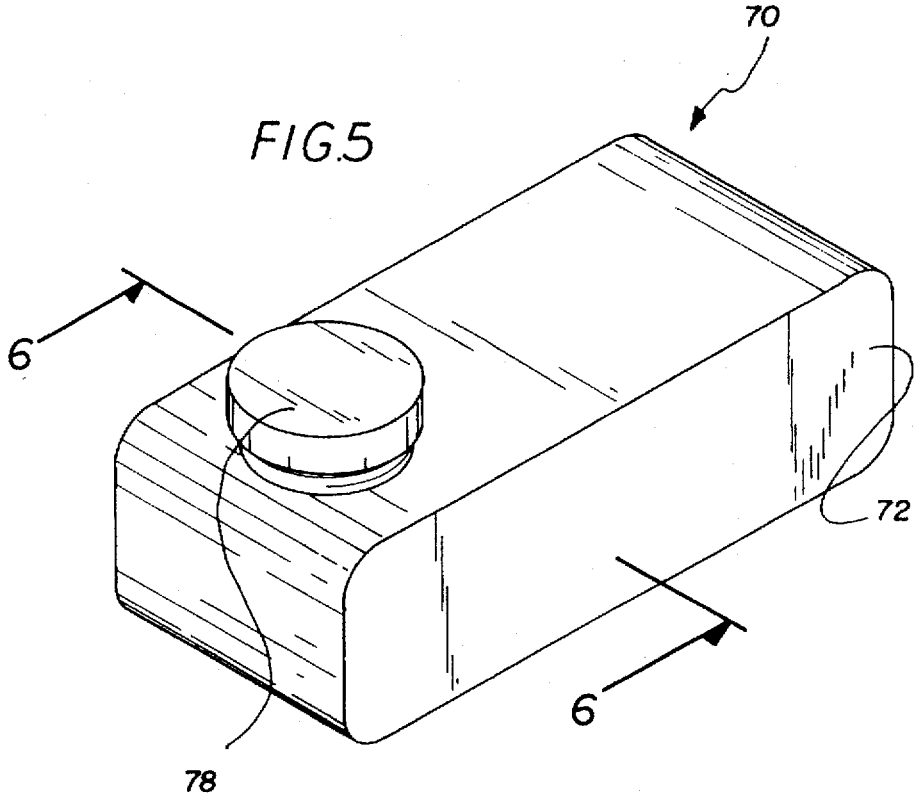
FIG. 5 is a top perspective view of the balancing weight of the present invention.
Figure 6:
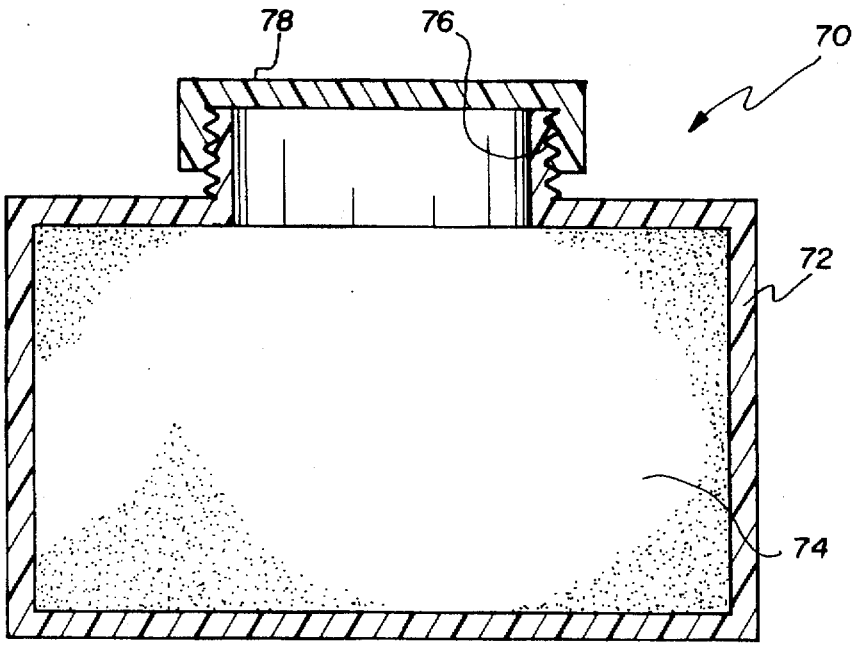
FIG. 6 is a cross-sectional view as taken along line 6—6 of FIG. 5.

With reference now to the drawings, and in particular, to FIGS. 1 through 6 thereof, the preferred embodiment of the new and improved dryer basket for sneakers embodying the principles and concepts of the present invention and generally designated by the reference number 10 will be described.

Specifically, it will be noted in the various Figures that the device relates to a dryer basket for sneakers for allowing laundered sneakers to be dried in an automatic dryer without any noise. In its broadest context, the device consists of three baskets, three mounting brackets and at least one balancing weight. Such components are individually configured and correlated with respect to each other so as to attain the desired objective.

The device 10 includes three baskets 12. Each of the baskets has a curved upper wall 14, a curved lower wall 16, an interior wall 18, an open exterior wall 20, and opposed side walls 22. The walls of the baskets are constructed of a rigid mesh material such as plastic or a Teflon coated metal. The curved upper and lower walls allow the baskets to conform to the dimensions of a dryer drum. Note FIGS. 1 and 2. The open exterior wall has a door 24 hingedly secured thereto. A pair of lid clips 26 are secured to an upper edge of the open exterior wall for engaging the door in a closed orientation to form an enclosure. The door is easily manipulated to allow sneakers or other articles to be added to or removed from the baskets as needed. The curved lower wall has a pivot clip 28 rotatably disposed within a slot 30 formed through the curved lower wall. The pivot clip has an upper arm 32 and a lower arm 34. A pivot pin 36 extends between the upper and lower arm and extends within the slot to allow for the rotation of the pivot clip freely with respect to the basket. Note FIG. 3. The curved lower wall has a retaining pin 38 extending downwardly therefrom. The retaining pin has an enlarged lower end 40.

The device includes three mounting brackets 44. Note FIGS. 3 and 4. Each of the mounting brackets have a planar upper surface 46, a planar lower surface 48 and opposed curved end portions 50. The planar lower surface has an adhesive layer 52 disposed thereon. The three mounting brackets are secured within a dryer drum 54 of a dryer 56 adjacent to tumblers 58 of the dryer. Note FIG. 1. A pair of mounting screws 60 are used to permanently secure the mounting brackets within the dryer drum. The adhesive layer can be used with the mounting screws or, alternately, instead of the mounting screws to allow the mounting brackets to be removed from the dryer drum. A peel away protective layer 62 is provided for covering the adhesive layer until it is to be used. The planar upper surface of each mounting bracket has a clip receiving slot 64 and a pin receiving slot 66 formed therein. The clip receiving slot is dimensioned for receiving the lower arm of the pivot clip therein and the pin receiving slot is dimensioned for receiving the enlarged lower end of the retaining pin therein whereby the three baskets are secured within the dryer drum adjacent to the tumblers. The three baskets can be easily removed from the dryer drum when not in use.

The device includes at least one balancing weight 70. Note FIGS. 5 and 6. The balancing weight comprises a container 72 holding a predetermined amount of sand 74 therein. The container has an open threaded collar 76 to facilitate adding to and removing sand from the container. A lid 78 is removably coupled with the collar. The balancing weight is positionable within one of the baskets. The balancing weight is provided for when less than all of the baskets are being utilized. By this, the balancing weight serves to maintain a balanced load within the dryer. Alternate forms of weights could also be utilized in the device.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A dryer basket for sneakers for allowing laundered sneakers to be dried in an automatic dryer without any noise comprising, in combination:

three baskets, each of the baskets having a curved upper wall, a curved lower wall, an interior wall, an open exterior wall, and opposed side walls, the open exterior wall having a door hingedly secured thereto, a pair of lid clips secured to an upper edge of the open exterior wall for engaging the door in a closed orientation to form an enclosure, the curved lower wall having a pivot clip rotatably disposed within a slot formed through the curved lower wall, the pivot clip having an upper arm and a lower arm, the curved lower wall having a retaining pin extending downwardly therefrom, the retaining pin having an enlarged lower end;

three mounting brackets, each of the mounting brackets having a planar upper surface, a planar lower surface and opposed curved end portions, the planar lower surface having an adhesive layer disposed thereon, the three mounting brackets secured within a dryer drum of a dryer adjacent to tumblers of the dryer, the planar upper surface of each mounting bracket having a clip receiving slot and a pin receiving slot formed therein, the clip receiving slot dimensioned for receiving the lower arm of the pivot clip therein and the pin receiving slot dimensioned for receiving the enlarged lower end of the retaining pin therein whereby the three baskets are secured within the dryer drum adjacent to the tumblers; and at least one balancing weight, the balancing weight comprising a container holding a predetermined amount of sand therein, the container having an open threaded collar to facilitate adding to and removing sand from the container, a lid removably coupling with the collar, the balancing weight positionable within one of the baskets.

2. A dryer basket for sneakers comprising:

a plurality of baskets;

a plurality of mounting brackets secured within a dryer drum of a dryer adjacent to tumblers of the dryer, the mounting brackets each having means for securement to the baskets whereby the baskets are removably secured within the dryer drum adjacent to the tumblers.

3. The dryer basket as set forth in claim 2 and further including at least one balancing weight, the balancing weight positionable within the baskets.

4. The dryer basket as set forth in claim 3 wherein the balancing weight comprising a container holding a predetermined amount of sand therein.

5. The dryer basket as set forth in claim 4 wherein the container having an open threaded collar to facilitate adding to and removing sand from the container, a lid removably coupling with the collar.

6. The dryer basket as set forth in claim 2 wherein each of the baskets having a curved upper wall, a curved lower wall, an interior wall, an open exterior wall, and opposed side walls, the open exterior wall having a door hingedly secured thereto, a pair of lid clips secured to an upper edge of the open exterior wall for engaging the door in a closed orientation to form an enclosure.

7. The dryer basket as set forth in claim 2 wherein the means for securement including a pivot clip rotatably disposed within a slot formed through the baskets, the pivot clip having an upper arm and a lower arm, the baskets having a retaining pin extending downwardly therefrom, the retaining pin having an enlarged lower end, the mounting brackets having a clip receiving slot and a pin receiving slot formed therein, the clip receiving slot dimensioned for receiving the lower arm of the pivot clip therein and the pin receiving slot dimensioned for receiving the enlarged lower end of the retaining pin therein.

* * * * *